United States Patent [19]

Hummel et al.

[11] Patent Number: 4,600,163

[45] Date of Patent: Jul. 15, 1986

[54] APPARATUS FOR CONTROLLED MANUAL UNROLLING OF ROLLED FLEXIBLE MATERIAL

[75] Inventors: John E. Hummel; William E. Baab, both of Tulsa, Okla.

[73] Assignee: Linear Films, Inc., Tulsa, Okla.

[21] Appl. No.: 448,614

[22] Filed: Dec. 10, 1982

[51] Int. Cl.[4] ..... B65H 23/06; B25B 33/00

[52] U.S. Cl. ..... 242/96; 242/99; 294/97

[58] Field of Search ..... 242/96, 99, 68.4, 72, 242/55, 55.2, 72 R; 188/74; 294/97

[56] References Cited

U.S. PATENT DOCUMENTS

| | | | |
|---|---|---|---|
| 521,245 | 6/1894 | Partridge . | |
| 1,110,136 | 9/1914 | Hundhausen | 242/72 R |
| 1,411,292 | 4/1922 | Mueller | 242/68.2 |
| 1,825,822 | 10/1931 | Rundell | 242/55.2 |
| 2,917,249 | 12/1959 | MacLelland | 242/55.2 |
| 3,652,027 | 3/1972 | Wong | 242/96 |
| 4,065,080 | 12/1977 | Alison | 244/155 |
| 4,102,513 | 7/1978 | Guard | 242/75.4 |
| 4,166,589 | 9/1979 | Hoover et al. | 242/55 X |
| 4,172,567 | 10/1979 | Post | 242/96 |
| 4,179,081 | 12/1979 | Parry | 242/99 |
| 4,248,392 | 2/1981 | Parry | 242/96 |
| 4,372,500 | 2/1983 | Saraisky | 242/55.2 X |

*Primary Examiner*—Stuart S. Levy
*Assistant Examiner*—Katherine Matecki
*Attorney, Agent, or Firm*—Hubbard, Thurman, Turner & Tucker

[57] ABSTRACT

A hand grip member for insertion in the end of a tubular core for flexible rolled material such as plastic stretch film includes opposed handle portions projecting from one side of a support web which includes cylindrical bearing shoe segments projecting from the other side of the support web. The handle portions are spaced apart and may be squeezed to move toward each other thereby deflecting the web to cause the bearing shoes to expand radially into gripping engagement with the inner wall of the roll core to selectively control the drag on the roll as the material is unrolled in the stretch wrapping process. The hand grip members are preferably used in pairs and are preferably molded in one piece of a suitable elastic material such as nylon.

13 Claims, 6 Drawing Figures

APPARATUS FOR CONTROLLED MANUAL UNROLLING OF ROLLED FLEXIBLE MATERIAL

BACKGROUND OF THE INVENTION

1. Field of the Invention

The present invention pertains to apparatus particularly adapted for controlled manual unrolling of rolled flexible material such as plastic stretch film wherein the film sheet is subjected to controlled tensioning during a wrapping or packaging process.

2. Background

Many types of wrapping materials are supplied in the form of substantially continuous rolls including material known as plastic stretch film. In the art of packaging and shipping systems thin stretchable plastic film sheet is widely used to wrap various types of loads such as a plurality of containers mounted on a pallet. Several methods have been developed including complicated automatic machines which operate to unroll flexible plastic stretch film while applying controlled tension to the film as it is wrapped around the load.

There are, of course, applications for the use of plastic stretch wrapping films wherein the use of an automatic machine is uneconomical or the machine is simply not adapted to wrap a particular shape or size of load. Manually operated devices have been developed for use in unrolling the wrapping film and controlling the tension of the film as it is wrapped around the load. In this regard there have been attempts to develop devices which are attached to or are supportive of a tubular core of the wrapping film roll to provide for applying tension to the wrapping film as it is dereeled from the core during the wrapping process. One such device comprises an elongated tubular core member having flexible sleevelike hand grips which are adapted to be sleeved over the opposed ends of the core and wherein the tension of the roll supported on the core is controlled by the squeezing of the hand grips into frictional engagement with the core as the roll is rotated with the core to dereel the wrapping film. Other devices are known which are considerably more complicated and somewhat defeat the advantages of a manual wrapping apparatus. However, in accordance with the present invention there has been developed a manual apparatus comprising a hand grip member which may be used singly or in pairs for controlled manual unrolling of rolled flexible material and is particularly adapted for controlled tensioning of stretchable wrapping films and the like during the wrapping process.

SUMMARY OF THE INVENTION

The present invention provides an improved manually operable apparatus for use in controlled unrolling and tensioning of rolled flexible material such as stretchable wrapping films or the like.

In accordance with one aspect of the invention there is provided a hand grip member which is adapted to be inserted into the end of a tubular core portion of a roll of flexible wrapping film or the like and which is also adapted to provide for controlled rotation of the roll as the material is unrolled whereby a selected amount of tension or stretch may be applied to the film as it is wrapped around a load.

In accordance with another aspect of the present invention there is provided a hand grip member particularly adapted for use in conjunction with rolls of stretchable wrapping film wherein a selective manual gripping or squeezing action applied to opposed handle portions of the member is operable to control frictional drag between a support bearing portion of the hand grip member and the roll of wrapping film supported by the member. The hand grip member may be used singly or preferably in pairs wherein the members are inserted into opposed ends of a roll of flexible wrapping film and, by a controlled manual squeezing action on the handle portions of the member or members, a predetermined drag or tensioning force may be applied to the film material as it is unrolled.

In accordance with yet another aspect of the present invention there is provided a hand grip type supporting and dereeling member for rolls of flexible material which is characterized by an integrally formed member having a bearing portion which is insertable into the end of a tubular roll core or a core adapter member, which bearing portion is formed of opposed bearing shoes which are engageable with the inner wall of the roll core and may be biased into forcible engagement with the core wall to provide a braking action to control the rotation of the roll with respect to the hand grip member. The bearing shoes are supported by an integral hinge formed by a web portion foldable about a hinge axis substantially perpendicular to the axis of rotation of the material roll whereby the bearing shoes may be moved into predetermined frictional engagement with the inner cylindrical wall of the roll core.

In accordance with still a further aspect of the present invention there is provided an integral one piece hand grip member for controlled dereeling of flexible stretch wrapping film wherein a handle portion of the member is formed by two opposed handle grips which are integrally joined at adjacent ends to a hinge member comprising a transverse web section of the hand grip member. The web section includes an integrally formed bearing portion engageable with the tubular core of a roll of flexible material or with an adapter for said roll, which bearing portion is formed of at least two opposed bearing shoes movable relative to each other to apply frictional drag to the roll during the dereeling process. The present invention also provides a hand grip member for manually controlling the dereeling of rolled flexible material, which member is formed of a molded elastic material such as structural plastic or the like.

Those skilled in the art of apparatus for controlled manual dereeling of rolled flexible material, such as stretchable wrapping films, will appreciate the abovedescribed features of the invention as well as other superior aspects thereof upon reading the detailed description which follows in conjunction with the drawings.

DESCRIPTION OF THE PREFERRED EMBODIMENT

Figure 1:
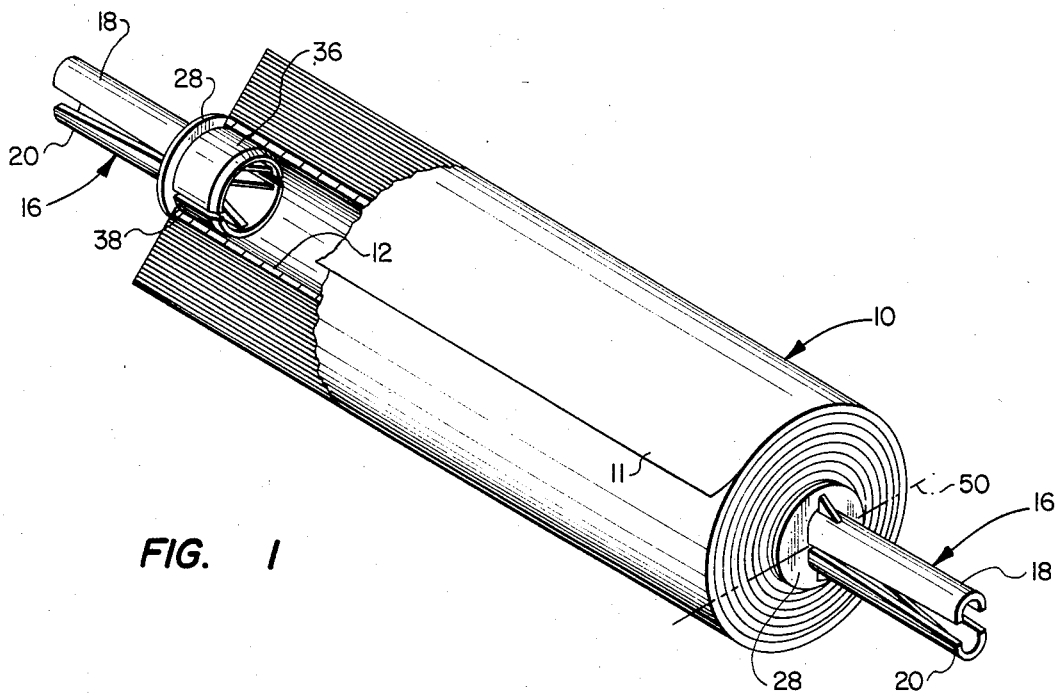
FIG. 1 is a perspective view of a roll of flexible plastic stretch film having the hand grip members of the invention disposed in opposite ends of the roll core.

In the description which follows like parts are marked throughout the specification and drawings with the same reference numerals, respectively. The drawings are not necessarily to scale and certain features may be exaggerated in scale to better illustrate the inventive concept and in the interest of clarity and conciseness.

Referring to FIG. 1, there is illustrated a roll of flexible sheet material, generally designated by the numberal 10, for use in conjunction with the apparatus of the present invention. The roll 10 is typically characterized by a stretchable plastic film which is formed in a continuous sheet 11 rolled onto a hollow tubular core designated by the numeral 12. Plastic films of various physical properties are used in so-called stretch wrapping processes in the packaging and shipping art. In this regard, it is necessary and desirable to suitably secure the leading end of the sheet 11 to a load secured to a pallet or the like, not shown, and then continuously dereel the sheet as the roll is moved relative to the load while at the same time applying tension to the sheet to stretch the film to form a tight clinging wrap around the load. In accordance with the present invention there is provided an improved apparatus for manually unrolling flexible sheet material from a tubular roll, such as the roll 10, while controlling the rotation of the roll during the dereeling process to apply tension to the material coming off the roll.

Figure 2:
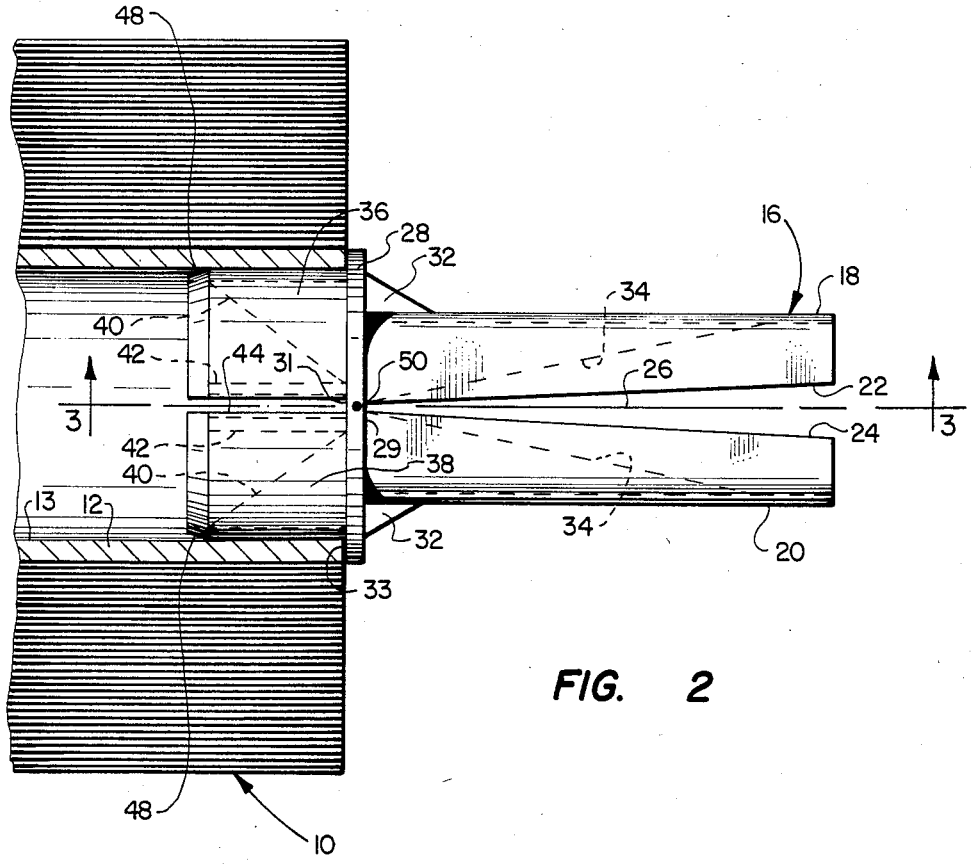
FIG. 2 is a longitudinal side view of one of the hand grip members inserted in the roll shown in FIG. 1.
Figure 3:
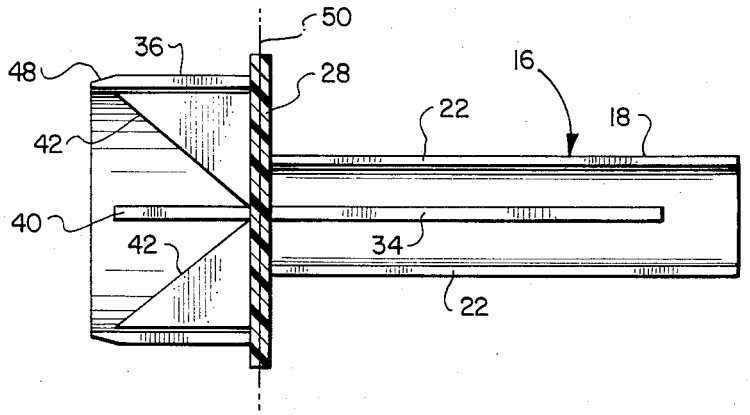
FIG. 3 is a section view taken along the line 3—3 of FIG. 2.
Figure 5:
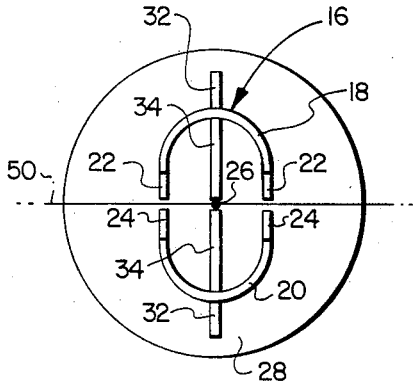
FIG. 5 is an end view of the hand grip member taken from the end opposite to that of FIG. 4.

Referring to FIGS. 1, 2 and 5 the apparatus of the present invention comprises a hand grip member, generally designated by the numberal 16, which may be provided singly or in pairs and inserted in the ends of the roll 10, as illustrated, for manually supporting the roll and for controlling the rotation of the roll relative to the apparatus as the flexible sheet 11 is dereeled whereby the tension and/or stretch in the sheet may be selectively controlled. Referring particularly to FIGS. 2 and 5, the hand grip member 16 is characterized by a pair of opposed handles 18 and 20 formed as hollow somewhat U-shaped members with opposed longitudinal side surfaces 22 and 24, respectively, which taper away from each other with respect to the longitudinal axis 26 of the member 16. One end of each of the handles 18 and 20 is fixed to a cylindrical disc shaped support member or web section 28. The side surfaces 22 and 24 of the respective handles 18 and 20 extend to a juncture with a surface 29 of the web section 28 to leave a gap between the handles throughout their entire length. Each of the handles 18 and 20 is preferably also interconnected with the web section 28 by respective gusset portions 32 and 34 to distribute forces exerted on the handles to the web section for a purpose to be described hereinbelow.

Figure 4:
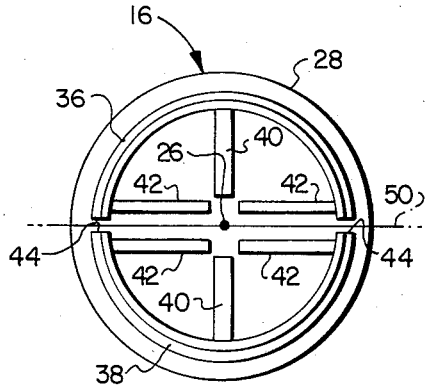
FIG. 4 is an end view of the hand grip member.

The hand grip member 16 also includes a cylindrical bearing portion comprising a pair of opposed tubular bearing or braking shoes 36 and 38 which are provided with cylindrical outer surfaces having a diameter selected to allow insertion of the bearing portion into the bore of the tubular core 12, as illustrated in FIGS. 1 and 2, in relatively close fitting relationship with the inner wall surface 13 but permitting rotation of the core relative to the member 16 while applying a controllable braking force. As shown in FIGS. 2 and 4 the opposed bearing shoes 36 and 38 are formed integral with the web section 28 and are secured to the web section by a plurality of gussets 40 and 42. Moreover, the bearing shoes 36 and 38 are spaced from each other to provide opposed slots 44 extending axially from the distal ends of the bearing shoes to a surface 31 of the web section 28. The distal ends of the bearing shoes 36 and 38 are preferably bevelled at 48, as shown, to facilitate insertion of the bearing portion of the hand grip member 16 into the bore of the core 12. The diameter of the web section 28 is preferably selected to be greater than the diameter of the bearing shoes 36 and 38 to form a transverse shoulder 33 to limit the extent to which the bearing portion may be inserted into the tubular core 12.

Thanks to the configuration of the spaced apart handles 18 and 20 a gripping or squeezing action on the handles to move them toward each other will result in bending of the web section 28 generally along a diametral line or hinge axis, designated by the numeral 50, in FIGS. 2, 4 and 5. Bending of the web section 28 as described will result in movement of the bearing shoes 36 and 38 away from each other and generally radially outwardly with respect to longitudinal axis 26 into frictional gripping engagement with the core wall 13. Accordingly, by controlling the squeezing action on the handles 18 and 20 a controlled amount of drag or frictional engagement of the bearing shoes 36 and 38 with the tubular core 12 may be obtained to provide for a braking action which tensions the flexible sheet as it is dereeled from the roll 10. Understandably, the amount of squeezing or gripping action exerted on the handles 18 and 20 may be controlled rather carefully, depending to some extent on the skill of the user of the apparatus, although such an operation does not require a great deal of operator skill.

The hand grip members 16 are preferably formed of an elastic material which will permit elastic deflection or bending of the web section 28 at least to the limit position wherein the surfaces 22 and 24 of the handles 18 and 20 are in abutting engagement with each other. By relaxing the gripping or squeezing action on the handles 18 and 20 the web section 28 returns to a substantially planar configuration wherein the drag or braking action of the bearing shoes against the core wall 13 is reduced accordingly. A suitable material for the hand grip members 16 would be a molded plastic such as nylon or the like and it is contemplated in accordance with the present invention that the hand grip members 16 would be integrally molded as single piece structures.

Those skilled in the art will appreciate from the foregoing description how one or, preferably, two of the hand grip members 16 may be inserted in a tubular core of a roll of flexible material for use in controlling the dereeling of the material by controlled squeezing of the handles 18 and 20 to exert a braking action on the roll core by the opposed bearing shoes 36 and 38. Although, as indicated, it is preferable to use two of the hand grip members 16 it is possible to support one end of the tubular roll by other bearing means while using a single hand grip member on the opposite end of the roll in the manner described. The outer diameter of the bearing shoes 36 and 38 is preferably selected to be adapted for use with standard sizes of tubular cores for rolls of flexible material such as plastic stretch film. However, for applications of the apparatus of the present invention for use with rolls of material having core diameters which are smaller than the diameter of the outer cylindrical surfaces of the bearing shoes 36 and 38, or substantially larger than the bearing shoes, various adapters for use with non-standard or alternate size cores can be provided such as the adapter shown in FIG. 6.

Figure 6:
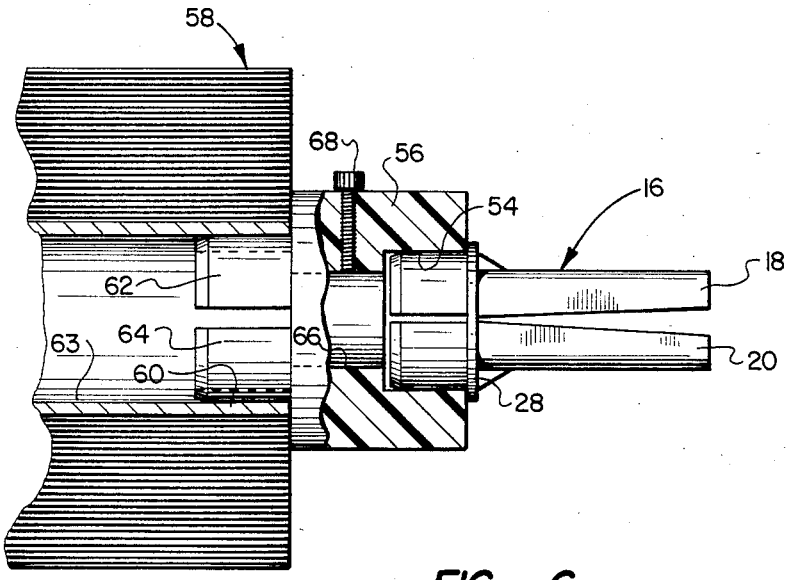
FIG. 6 is a detail view of one of the hand grip members inserted in an adapter for use in conjunction with a roll having a core diameter larger than the core bearing portion of the hand grip member.

Referring to FIG. 6, there is illustrated one of the hand grip members 16 inserted in a bore 54 provided in a cylindrical member 56 comprising an adapter for use with a roll 58 having a tubular core 60. The adapter 56 in itself may be provided with opposed bearing portions 62 and 64 similar to the bearing shoes 36 and 38 but suitably oversized with respect to the bore 63 of the core 60 so that they forcibly and non-rotatably engage the core 60. Moreover, the adapter 56 is also preferably provided with a cylindrical bore 66 and a set screw 68 whereby rolls having tubular rodlike cores axially extending beyond the lateral edges of the roll could be inserted in the bore 66 and non-rotatably secured to the adapter by the set screw. Accordingly, the adapter 56 may be used with selected non-standard rolls having core diameters which would not permit insertion of the bearing shoes of the hand grip member 16 directly into the core itself.

Those skilled in the art will appreciate from the foregoing description that a particularly unique yet mechanically uncomplicated apparatus has been provided in accordacne with the present invention for use in controlled manual unrolling of rolls of flexible material. The apparatus described herein is particularly useful in the application of plastic stretch film wrapping or covering material. Those skilled in the art will also recognize that various substitutions and modifications of the specific embodiment described herein may be made without departing from the scope and spirit of the invention as recited in the appended claims.

What is claimed is:

1. An integral one piece molded plastic member for supporting the end of a tubular roll of plastic stretch wrap film for manually unrolling said film and controlling the tension in said film during the unrolling process, said member including a web portion bendable about a hinge axis, a pair of opposed handles projecting from said web portion and integrally joined to said web portion spaced apart on opposite sides of said hinge axis, a pair of bearing shoe segments integrally joined to said web portion opposite respective ones of said handles and on opposite sides of said hinge axis, said bearing shoe segments each having a bearing surface and being insertable in a bore formed in a core of said roll when said handles are relaxed, said bearing shoe segments being deflectable into frictional gripping engagement with said core upon bending of said web portion about said hinge axis in response to gripping said handles to move said handles relative to each other.

2. Apparatus for controlled manual unrolling of a tubular roll of flexible material and the like, said roll including core means defining a cylindrical bore, said apparatus comprising:

a hand grip member including a handle portion defined by handle means projecting from a supporting web, said handle means being movable in response to a manual squeezing action exerted thereon; and bearing means insertable in the bore of said core means and comprising a plurality of bearing shoes each having a bearing surface engageable with the bore wall of said core means in supportive relationship to said roll and to permit rotation of said roll relative to said apparatus, said bearing shoe being fixed to said web and projecting from a side of said web opposite said handle means; and said web being deflectable about a hinge axis to cause said bearing shoes to spread radially outwardly away from each other into forcible frictional engagement with said bore wall of said core means in response to movement of said handle means under a squeezing action exerted thereon to control the tension in said wrapping material as it is unrolled from said core means.

3. The apparatus set forth in claim 2 wherein:

said handle means comprise a pair of opposed handles spaced from each other, said handles each including surface means engageable with surface means on the other handle to delimit the movement of said handles toward each other.

4. The apparatus set forth in claim 2 wherein:

said apparatus is formed in one piece of molded plastic.

5. Apparatus for controlling the unrolling of a roll of flexible stretch plastic wrapping film, said roll including means forming a core of said roll and defining a cylindrical bore at opposite ends of said roll, said apparatus comprising a pair of hand grip members each formed in one piece of molded plastic and adapted for insertion in said bore at said opposite ends of said roll, respectively, for manually supporting said roll for controlled rotation of said roll to tension said film during unrolling of said film from said roll, said hand grip members each comprising a handle portion including a pair of opposed elongated handles spaced from each other, said handles being connected at adjacent ends to a connecting web section, bearing shoe means of said hand grip members connected to said web section opposite said handles and having a bearing surface adapted to be inserted in said bore in said roll in supportive relationship to said roll and permitting rotation of said roll with respect to said bearing means, said bearing surface being movable into controlled frictional engagement with a wall of said bore in response to a gripping action exerted on said handles to control the tnesion in said film as it is unrolled from said roll to stretch said film during application to wrap a load.

6. Apparatus for controlling the unrolling of a roll of flexible stretch plastic wrapping film, said roll including means forming a core of said roll, and adapter means for supporting said roll and defining a cylindrical bore at opposite ends of said roll, said apparatus comprising a pair of hand grip members adapted for insertion in said bore at said opposite ends of said roll, respectively, for manually supporting said roll for controlled rotation of said roll to tension said film during unrolling of said film from said roll, said hand grip members each comprising a handle portion including a pair of opposed elongated handles spaced from each other, said handles being connected at adjacent ends to a connecting web section, bearing shoe means of said hand grip members connected to said web section opposite said handles and having a bearing surface adapted to be inserted in said bore in said roll in supportive relationship to said roll and permitting rotation of said roll with respect to said bearing means, said bearing surface being movable into controlled frictional engagement with the wall of said bore in response to a gripping action exerted on said handles to control the tension in said film as it is unrolled from said roll to stretch said film during application to wrap a load.

7. Apparatus for controlled manual unrolling of a tubular roll of flexible wrapping material and the like, said roll including core means including a portion having a generally cylindrical bore defined by a borewall, said apparatus comprising a hand grip member including;

bearing means comprising a plurality of bearing shoes insertable in said bore and each having a bearing surface engageable with said borewall, and to permit rotation of said roll relative to said bearing means, said bearing shoes being supported with respect to each other by hinge means;

handle means movable in response to a manual force exerted thereon for selectively controlling engagement of said portion of said core means by said bearing means to control the tension in said wrapping material as it is unrolled from said core means; and a web forming said hinge means between said handle means and said bearing means whereby said bearing shoes and said handle means project from opposed sides of said web, said web being deflectable about a hinge axis to provide for pivotal movement of said handle means and said bearing means for causing said bearing shoes to spread radially outwardly away from each other into selectively variable forcible engagement with said borewall in response to a squeezing action exerted on said handle means to selectively vary frictional drag between said borewall and said bearing means to control the tension in said wrapping material as it is unrolled from said core.

8. The apparatus set forth in claim 7 wherein:

said apparatus is formed in one piece of molded plastic.

9. Apparatus for controlled manual unrolling of a length of flexible material wound on a tubular core defining an open ended cylindrical bore, said apparatus comprising:

a pair of spaced apart, elongated hand grip means disposed in generally parallel relationship to a longitudinal axis, and sized and spaced to be grasped by a single operator's hand and moved together;

a pair of spaced apart brake shoe means sized to be received in the open ended cylindrical bore and to exert a variable sliding braking force on the interior surface of the cylindrical bore when forced apart and spaced from the hand grip means; and mechanical means interconnecting the hand grip means and the brake shoe means for forcing the brake shoe means apart to exert a variable sliding braking force on the core in response to a manually applied force on the hand grip means whereby an operator can both hold the core and roll of material thereon and control the tension of the flexible material as it is unwound from the core.

10. Apparatus for controlled manual unrolling of a length of flexible material wound on a tubular core defining an open ended cylindrical bore, said apparatus comprising:

a pair of elongated members generally aligned with a longitudinal axis;

pivot means pivotally interconnecting midpoints of the elongated members and forming a pivot axis extending transverse to the longitudinal axis and permitting relative pivotal movement between the elongated members about the pivot axis;

hand grip means on the members on one side of pivot axis facilitating holding the members in the hand and pivotally moving the members one relative to the other about the pivot axis;

brake shoe means connected to the members on the other side of the pivot axis and sized to be inserted in the cylindrical bore of the core means for applying a variable and controllable braking force to retard rotation of the core means thereabout as the shoe means are moved apart in response to pivotal movement of the members about the pivot axis as the hand grip means are moved together by the hand of an operator, whereby the operation can control the tension of the flexible material as it is pulled from the roll.

11. The apparatus of claim 10 wherein the pivot means is formed by a flexible web member extending transversely of the longitudinal axis and interconnecting the elongated members.

12. The apparatus of claim 11 wherein the elongated members and the web member are an integrally molded unit.

13. The apparatus of claim 12 wherein the entire apparatus is an integrally molded unit.

* * * * *